United States Patent [19]

Capriotti

[11] 4,290,289

[45] Sep. 22, 1981

[54] SPACIAL ALIGNMENT METHOD FOR ROLLING MILL ROLLS AND CHOCKS

[75] Inventor: Alfred J. Capriotti, Falls Township, Bucks County, Pa.

[73] Assignee: United States Steel Corporation, Pittsburgh, Pa.

[21] Appl. No.: 121,858

[22] Filed: Feb. 15, 1980

[51] Int. Cl.[3] ..... B21B 31/16; B21C 51/00

[52] U.S. Cl. ..... 72/31; 72/35; 72/243; 72/237; 33/182

[58] Field of Search ..... 72/31, 35, 243, 247, 72/238, 244, 237; 33/182 X; 100/160

[56] References Cited

U.S. PATENT DOCUMENTS

| | | | |
|---|---|---|---|
| 1,900,344 | 3/1933 | Iversen | 72/243 |
| 1,953,165 | 4/1934 | George | 72/243 |
| 2,054,530 | 9/1936 | Williams | 33/182 |
| 4,003,133 | 1/1977 | Pierik | 33/182 |

*Primary Examiner*—Milton S. Mehr

*Attorney, Agent, or Firm*—William A. Danchuk; John F. Carney

[57] ABSTRACT

A method of aligning each of the rolls in a rolling mill such that each of the axes of rotation are substantially parallel to one another and do not present a crossed-roll condition. The alignment method does not involve the disassembly of the chock arrangement and associated bearings, but utilizes the determination of a special orientation of each of the lateral chock face planes with respect to the axis of rotation of the associated roll. Once this spacial orientation has been determined, it is then utilized in the analysis of the chock, roll and bearing tolerances and alignment and in the selective placement of necessary corrective spacing elements between the lateral chock face planes and their support within the rolling mill to physically adjust the chock face plane and the axis of rotation of the associated roll such that each of the axes of rotation of each roll are parallel to one another.

23 Claims, 12 Drawing Figures

SPACIAL ALIGNMENT METHOD FOR ROLLING MILL ROLLS AND CHOCKS

BACKGROUND OF THE INVENTION

The reliability of a rolling mill is primarily dependent upon the maintenance as well as the proper alignment of the components included therein. Improper roll and roll chock conditions can so adversely affect bearing performance and rolling mill practices that both down time as well as product quality may be adversely affected. At the present time the proper alignment of equipment components is becoming more of a factor as competitive pressure force rolling mills to increase their productivity of both hot and cold rolled product. Specifically, this means increases the mill loads, running at higher speeds, and using work roll or backup roll bending for accurate shape control. It is obvious that these operating conditions subject the backup rolls, work rolls and the bearing chocks to increasing demand. Maintenance of all of these items in a proper and effective manner is an absolute necessity to achieve increased mill productivity.

In a typical rolling mill both the backup rolls and the work rolls have center lines which are substantially parallel to each other. Ideally, the center lines of the top and bottom work rolls are on a common vertical line as is the center line of the backup rolls. In some cases a slight horizontal offset is incorporated between the center lines of the work rolls and the center lines of the backup rolls. Typically, this offset is in a direction toward the exit side of the mill. However, even under such situations all of the center lines of the work rolls and the backup rolls should be substantially parallel to one another.

When a strip rolling mill operates with the roll center lines in this fashion and equal or even strip rolling pressure exists across the width of the mill, the operation of the work roll bearings contained within the chock is nearly ideal. A substantial radial load on the bearings is expected due to the roll balance load and/or work roll bending loads. Other bearing loads which might occur are due to differences in strip tension between the entry side of the mill and the exit side of the mill. These forces, however, can be predicted and accommodated for in the original design of the mill. Unexpected loads on the bearings, chocks and the rolls themselves can be anticipated but not normally accommodated for in a crossed-roll condition.

A crossed-roll condition which causes serious work roll problems and backup roll problems to the bearings and product quality exists when the vertical center line of the top and bottom work roll necks are not in exact vertical relationship to each other and are not in a parallel relationship across the width of the mill. The positioning error on one side of the mill may not occur on the opposite side of the mill. If this positioning error becomes significant, the mill operator may detect a widening of the roll gap on one side of the mill and may correct for the situation by adjusting only one mill screw to achieve a closer gap. In such a case the quality of the product may not be adversely affected by a crossed-roll condition but undesirable wear to the rolls, bearings and chocks can be expected.

When the crossed-roll condition becomes exaggerated, there may in fact be an adverse affect to the quality product as well as to the life of the rolls, bearings and chocks. When the strip product enters the mill, it forms an intermediate direct contact with the two work rolls and, due to the slightly divergent surface direction of the mated rolls, tend to push each of the rolls away from the other. This interaction between the rolls generates axial forces which tend to push them out of the mill and may result in substantial wear, fracture and maintenance problems to the mill in general and to each of the above noted elements specifically. In addition, such a condition would result in a product quality which is less than desirable.

The massive forces needed to counteract the generated thrust load are applied to the work roll bearings and chocks on the operator side of the mill. The magnitude of the generated thrust force is primarily influenced by the magnitude of the mill separating force and the degree of the positioning error that results in crossed rolls. If a mill is operated with a severe crossed-roll condition, the work roll thrust load may be ten times the work roll thrust loads normally expected when such rolls are operated in a substantially parallel direction of rotation. These increased thrust loads would result in a reduction in the life of the bearings and chocks in some cases of several hundredths of the normal life expectancy of these elements.

Normal maintenance and setup procedures used in the past have relied upon the alignment of the center lines of each of the rolls through a procedure which involves the completed breakdown of the chock components, including the bearings, and the measurement of distances and tolerances from the inside of the chock toward the outside lateral support faces. While not only being time consuming, these practices become expensive and are not indicative of the spacial orientation of the lateral support faces of the chocks relative to the axis of rotation. It therefore becomes apparent that a substitute method for the calculation of the positioning of the lateral supportive chock faces with regard to the center line of the associated roll would be advantageous in the proper maintenance and alignment of the rolls within the mill. Such a method would not only obviate the need for the disassembly of the roll and chock, but would provide a more reliable and efficient method for determining such spacial orientation for the proper alignment of the roll center lines.

SUMMARY OF THE INVENTION

The present method is addressed to a procedure for aligning each of the plurality of rolls in a rolling mill such that their axes of rotation are substantially parallel to one another. The alignment procedure includes the steps of determining the spacial orientation of each of the supportive chock planes which provide lateral support to the chock and their lateral roll. Once the spacial orientation has been determined, correcting spacing elements may be placed between the chock face planes which laterally support the chock and their lateral support within the rolling mill so as to physically laterally adjust the chock face and the axis of rotation of the roll. The method of the present invention obviates the need for the disassembly of the chock elements and the calculation of thicknesses and tolerances associated with the chock element starting with the inside and working out. Additionally, a plurality of points may be established on the lateral support face planes of the chock, thereby providing the operator with a spacial orientation of the face plane and not merely a one point distance measurement from the axis of rotation. Utilizing this method, the operator is better able to determine how best to reorient the chock with respect to its supportive elements in the mill, thereby assuring a closer approach or approximation to the ideal situation in which each one of the rolls in the rolling mill has an axis of rotation parallel to all others.

Accordingly, it is a general object and feature of the present invention to provide a method of aligning a plurality of substantially vertically aligned rolls in a rolling mill and the associated support chocks therefor such that each of the rolls' axis of rotation are substantially parallel without the necessity for disassembling the elements contained within the chocks.

It is another object and feature of the present invention to provide a method of aligning each of the rolls of a rolling mill such that the axes of rotation are substantially parallel, the method including the determination of the spacial orientation of each of the lateral chock face planes with respect to the axis of rotation of their associated rolls.

It is yet another object and feature of the present invention to provide a method of aligning the rolls of a rolling mill including both the backup rolls and the work rolls such that the axes of rotation are substantially parallel even in situations in which the backup roll chocks support the work roll chocks such that each of the axes of rotation for each roll is substantially parallel to all others.

Other objects and features of the present invention will, in part, be obvious and will, in part, become apparent as the following description proceeds. The features of novelty which characterize the invention will be pointed out with particularity in the claims, annexed to and forming part of the specification.

BRIEF DESCRIPTION OF THE DRAWINGS

The novel features which are considered characteristic of the invention are set forth with particularity in the appended claims. The invention itself, however, both as to its structure, as well as its operation together with the additional objects and advantages thereof will best be understood from the following description of the preferred embodiment of the present invention when read in conjunction with the accompanying drawings wherein:

DETAILED DESCRIPTION OF THE INVENTION

Figure 1:
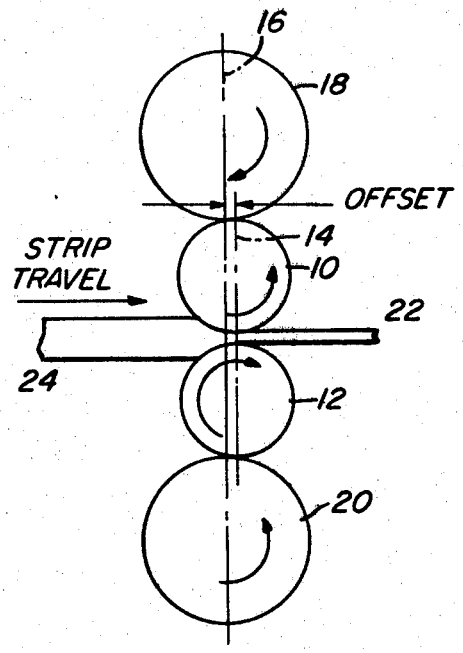
FIG. 1 is a schematic side view of the relative positioning of rolls in a mill stand with respect to one another.

Looking to FIG. 1 there is shown a typical schematic view of the work rolls and backup rolls in a four-high rolling mill. In many cases, the center lines of the top and bottom work rolls 10 and 12, respectively, are located on a common vertical line 14 as are the center lines 16 of the upper and lower backup rolls 18 and 20, respectively. In most cases a slight horizontal offset is incorporated between the center lines of the work rolls and the center lines of the backup rolls as indicated in FIG. 1. This offset is usually in a direction toward the exit side of the mill 22 and not on the entrance side 24, although this latter condition may exist in some cases. A rolling mill operating with the roll center lines presented in FIG. 1 presents a nearly ideal working condition in which the strip rolling pressures which exist across the width of the mill are equal. Other radial loads on the bearings, chocks and rolls are expected and can be predicted and accommodated for by normal rolling procedures. As indicated previously, this condition is ideal and rarely exists for any appreciable amount of time in any rolling mill.

Figure 2:
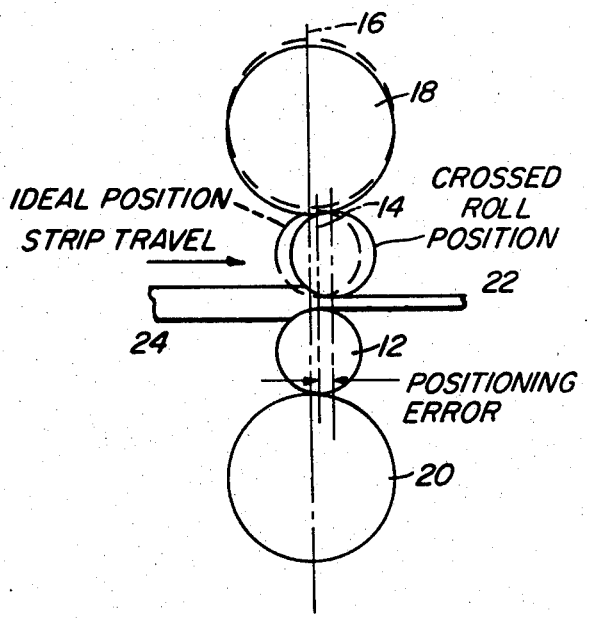
FIG. 2 is a schematic side view of the relative positioning of rolls in a mill stand when the rolls are in a crossed roll position.

FIG. 2 which is a schematic representation of a crossed roll position, is more indicative of the actual situation and positioning of the rolls in a given mill. In the crossed roll position case indicated in FIG. 2 the top backup roll 16 and top work roll 10 have been displaced from their ideal positions indicated in dashed lines therein due to movement of one or both sides of the work roll 10 toward the exit side 22 of the mill and away from the entrance side 24 of the mill. Obviously, any lateral displacement in the direction noted of the work roll 10 will cause vertical displacement of the axis of rotation of the backup roll 18. The lateral movement (which may occur over an appreciable amount of time) of the upper work roll 10 from its ideal position to its crossed roll position creates a positioning error indicated in FIG. 2 which may occur on only one side of the mill and not on the other. In practical situations the effect of the severity of the positioning error will depend upon the material being rolled, its speed, its composition and the type of mill in which such error is presented. However, it should be recognized that a positioning error of several thousandths of an inch may adversely affect the rolling conditions of that mill. If the positioning error becomes significant, the mill operator may detect a widening of the roll gap on one side only and correct for that situation by adjusting only one mill screw to achieve a closer gap. However, since product quality may not be adversely affected by a crossed roll condition, the only observable trouble would be the insufficient life of the work roll bearings due to excessive roll thrust.

Figure 3:
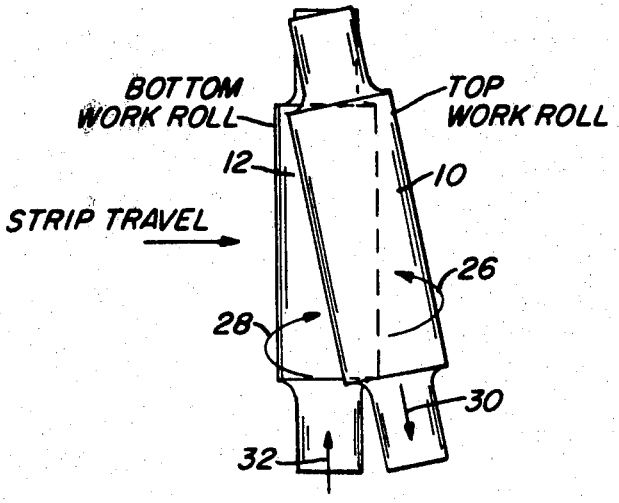
FIG. 3 is a schematic top view of the relative positioning of rolls in a mill stand when the rolls are in an exaggerated crossed roll position.

A different view of a crossed roll condition is found in FIG. 3. FIG. 3 represents a top view of a pair of work rolls 10 and 12 in an exaggerated crossed roll condition. The strip passing between the rolls forms an intermediate direct contact between the two work rolls and, due to the slightly divergent surface direction of the mated rolls, each work roll tends to push away from the other work roll in the directions indicated at 26 and 28. This interaction between the two rolls 10 and 12 generates axial forces 30 and 32 which tend to push the rolls out of the mill and may adversely change the roll bending characteristics of the mill in general. In addition, and as previously noted, the crossed roll position may result in poor product quality, excessive thrust forces and a drastic reduction in the calculated fatigue life of the bearings which are used to interface the rolls with their support chocks. For example, a mill operating with a severe crossed roll condition may generate a work roll thrust load of approximately 5% of the necessary separating force between the two rolls. If the generated thrust force could be reduced to ½% of the separating force, the roll bearings would have a calculated fatigue life of more than 500 times that calculated at the 5% level.

The center line position of the work rolls on both ends of the work rolls as well as the backup rolls is controlled by the position of the supportive chock and the chock bore, the roll bearings as well as the thicknesses of liners positioned between the lateral support faces of the chocks and the chock's lateral support within the mill. As will be discussed later, in some cases this may be the mill housing itself or it may be supportive faces located on the backup roll chocks.

Figure 4:
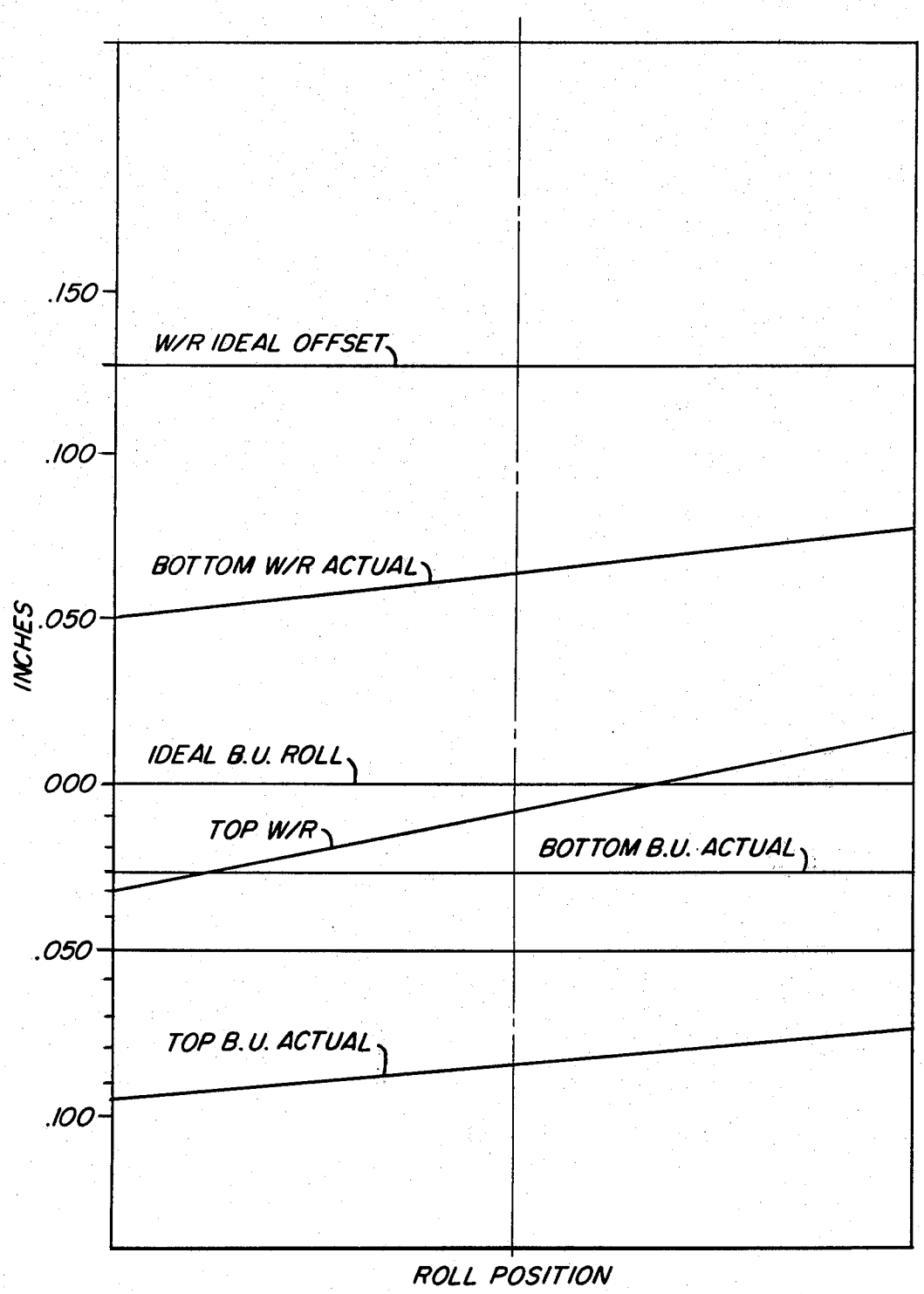
FIG. 4 is a graphic representation of an actual and representative crossed roll and roll offset condition determined by the applicant.

FIG. 4 represents a graphic representation of the relative side-to-side positions of each of the four rolls located in a four-high rolling mill. For purposes of clarity, ideal offsets are indicated for the work rolls and, in addition, an ideal backup roll center line is provided. The graphic display shown in FIG. 4 is an actual condition which applicant has found in a rolling mill and shows the amount of displacement from the ideal of both work rolls as well as backup rolls. In some cases, displacement of the actual location from the ideal location may be in excess of 130 thousandths of an inch on one side. Such drastic deviations may very likely produce sub-quality product and place the rolls, bearings and chocks in a situation which drastically reduces their life expectancy. The specific causes for the dislocation of work rolls and backup rolls from their ideal position has been discussed previously. Improper roll alignment, improper liners and variations in roll neck diameters all affect the work roll and backup roll alignment. An undersized roll neck adds to the positioning error of the work roll center line. This is particularly true when the roll neck diameters vary between the operator end of the roll and its drive end. Another form of misalignment may occur within the bearing and roll chock. This condition causes load concentrations on small areas of the bearings and the bearing faces resulting in overloading conditions.

Previous methods for attempting to properly align the center lines of the rolls in a mill so that their axes of rotation are parallel have been centered on a rebuilding of the chock and bearings from the inside out. Supportive elements within the chock including the bearings and their races are measured precisely and tolerances for the mating of individual elements with one another are taken into consideration. The final result of such measurements and rebuilding is a measurement determination of the distance between one point on the lateral chock face and the axis of rotation or center line of the roll. Such measurements have been used to calculate the necessary thickness of liners or shims placed between the outside surface of the chock and its supportive element within the rolling mill. What such measurement methods do not take into consideration, however, is that the spacial orientation of the lateral faces of the chock may vary appreciably, for instance, from its top to its bottom thereby varying from the measurement distance obtained through the rebuilding of the chock elements. Such spacial disorientations of the lateral support faces of the chock would not be recognized by prior practices and would be permitted to exist, thereby leading to the improper shimming of chocks and the misalignment of rolls away from a parallel center line condition. One primary indication of the impracticality of previous alignment methods is the fact that an actual center line displacements noted in FIG. 4 are not particularly drastic, but is merely a representative condition found in the rolling art.

In order to appreciate the need for more than one measurement of the lateral faces of the chock with respect to the axis of rotation or center line of the roll one must appreciate how the rolls, bearings and chocks all fit together within a mill. While there are a variety of mills with various roll and chock combinations, two major types of rolling mills will be described herein. In both cases there are provided two backup rolls and two work rolls for each four-high stand. In addition, both cases or types of mills are configured such that lateral support for the backup rolls is provided by the mill housing itself. However, lateral support for the work roll chocks in one case is provided by the backup chock and in another case by the mill housing itself. For instance, the former situation (in which support for the work roll chocks is provided by the backup roll chock) is shown in FIG. 5.

Figure 5:
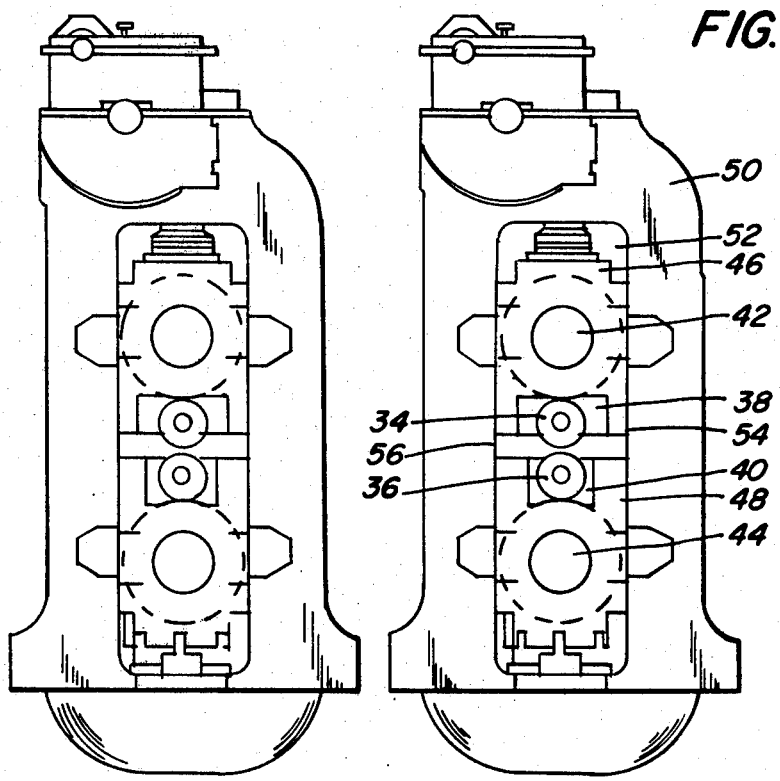
FIG. 5 is a side view of two, four-high rolling stands in which lateral support for the work roll chocks is provided by the backup roll chocks.

Looking to FIG. 5, there is shown two stands of a multiple stand rolling mill, both stands having two work rolls 34 and 36 and associated chocks 38 and 40 and two backup rolls 42 and 44 and associated supportive chocks 46 and 48, respectively. The rolls and the supportive chocks are contained within a mill housing 50 having a generally elongated oval shape with a generally rectangular opening 52 provided therein. The rectangular opening 52 is defined in part by flat vertical sides 54 and 56 which, in the case shown in FIG. 5, provide the lateral support for the backup roll chocks 46 and 48. The work rolls 34 and 36 are retained for rotational movement by their respective chocks 38 and 40. In turn, chocks 38 and 40 are contained and retained by windows or cut-outs formed within the backup roll chocks 46 and 48 as shown in FIG. 5. Consequently, the lateral support for the rolls 34 and 36 and their associate chocks 38 and 40 is provided through the backup roll chocks 46 and 48.

Figure 6:
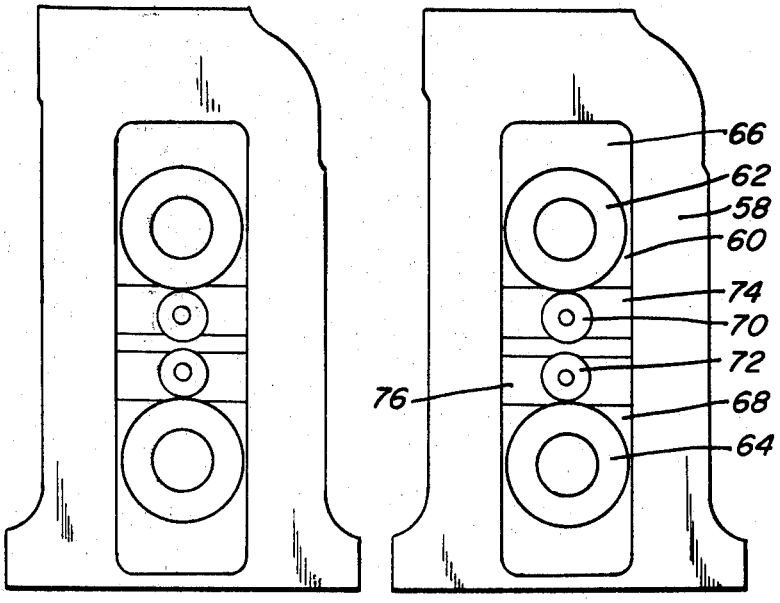
FIG. 6 is a side view of two, four-high rolling stands in which the lateral support for all chocks including the backup roll chocks and the work roll chocks is provided directly by the mill housing itself.

Looking to FIG. 6, there is shown a different variety of four-high rolling mill. In particular, the housings 58 include the same rectangularly shaped opening 60 as that shown in FIG. 5. Contained within the opening 60 are two backup rolls 62 and 64 along with their associated chocks 66 and 68, respectively. In the same manner as described with relation to FIG. 5, the backup roll chocks 66 and 68 derive their lateral support directly from the mill housing 58. Also provided within the opening 60 in the mill housing 58 are two work rolls 70 and 72 with their associated chocks 74 and 76. However, the work roll chocks 74 and 76 in the example shown in FIG. 6 derive their lateral support not through window or openings in the backup roll chocks but instead, directly from the mill housing 58 as the backup roll chocks 66 and 68 do.

In any alignment procedure the relative positions of the chocks (and obviously of the rolls supported thereby) is accomplished through the placement of shims or spacing elements between the chock and its laterally supportive element within the mill itself. In the example shown in FIG. 5 above, any alignment spacers or shims for the backup roll chocks would be placed between the backup roll chock and the mill housing in order to properly align that chock and its associated roll to a theoretical position. Similarly, any alignment shims or spacing elements employed for properly aligning the work rolls and their chocks in the example shown in FIG. 5 would be placed between the lateral work roll chock face and the window provided by the backup roll chocks, inasmuch as the former derives its lateral support from the latter. However, in the example shown in FIG. 6, any alignment shims or spacing elements employed for properly aligning the work rolls and associated chocks would be placed between the lateral supportive surfaces of the work roll chock and the mill housing inasmuch as the former derives its lateral supportive force from the latter. The placement of alignment shims and spacing elements between the chock faces and their lateral supportive elements within the mill itself is not new, may be readily obtained through the current state of the art procedures for such alignment and will not be further discussed herein. However, such prior alignment practices have assumed that a single measurement taken between the axis of rotation of the roll and the lateral supportive face of the chock is sufficient to determine the spacial orientation of the latter face. Applicant's research and study in this regard have shown that such assumptions and presumptions are in error, thereby leading to the continuation of the alignment problem previously discussed. Applicant's procedure for determining the spacial orientation of each of the lateral supportive faces for each supportive chock do not presume that a single measurement between the chock face and the axis of rotation of the associated roll is adequate for determining the spacial orientation of the chock face, and in fact, applicant's method utilizes a plurality of points on each chock face in order to determine not only that faces spacial orientation (assuming a theoretical planar face) but also provides for the measurement of warp and wear in particular in specific places on the chock face so that shims and correcting elements of differing sizes and thicknesses may be placed where best needed to properly align the chock and associated roll.

Figure 7:
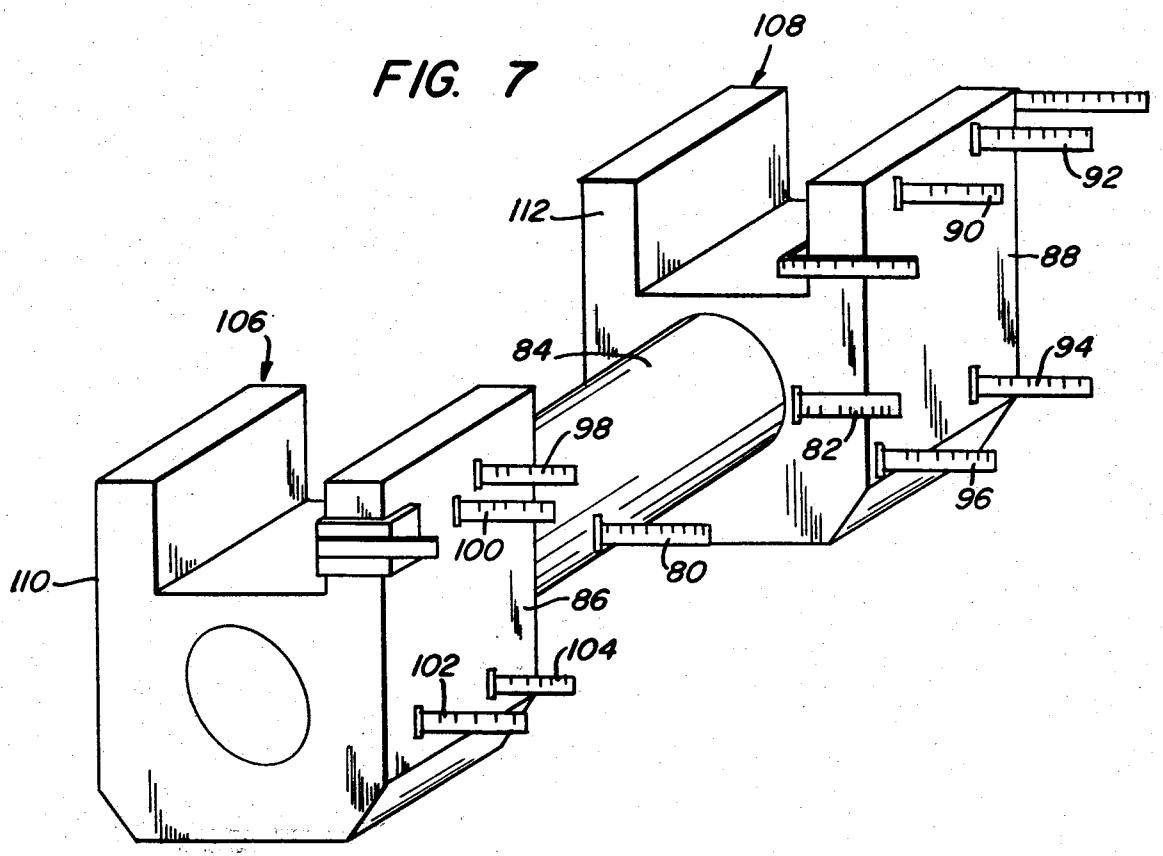
FIG. 7 is a prospective view of the relative positioning of measurement scales on a representative backup roll in accordance with the method according to the present invention in order to determine the spacial orientation of the lateral support faces of the backup roll chocks.

Looking to FIG. 7, there is shown a prospective schematic view of a backup roll and its two associated chocks along with measurement rules or elements which are employed in the applicant's method to determine spacial orientation of the lateral supportive faces of the chocks. It should be noted at the commencement of this description of the preferred embodiment of the present invention that while optical instruments such as surveying scopes as mentioned herein, applicant does not simply imply that the measurement determinations to be explained below are limited to the use of such instruments alone. For example, other measurement instruments including lasers and sonar devices may be employed in the performance of the present method. At the start of the spacial orientation determination, the particular roll to be measured along with its chock is placed in either a supportive rack (to be explained below) or, alternatively, is placed upon a relatively level portion of the mill floor. An optical surveying scope is positioned back from one end of the roll such that its line of sight is substantially parallel to the axis of rotation of the roll in question. Alternatively, the optical instrument may even be placed on a chock face, roll body or somewhere remote or suspended in air to achieve the same calculations and determinations within the scope of the method according to the present invention. Such alignment need not be precisely made, but as will be seen later, aids the operator in this method determination when it is relatively closely aligned in a parallel relationship with the roll's axis of rotation. The optical scope is leveled in all directions and is then aligned with its line of sight substantially parallel to the axis of rotation of the roll but removed a sufficient distance therefrom to enable the operator to view measurement elements placed on the lateral supportive faces of the chocks with some amount of ease and convenience.

In order to align the scope's line of sight such that it is substantially parallel to the axis of rotation of the roll in question, it is first necessary to place measurement elements or scales on the surface of the roll so that they extend substantially radially outwardly from the axis of rotation of the roll and into the line of sight of the scope. The attachment of such measurement elements or scales to the roll may be achieved through magnets and the like and they are oriented to extend radially outwardly from the roll by known devices and procedures. In addition, each of the measurement scales or elements as at 80 and 82 is oriented on the roll such that it extends horizontally and the latter is ensured through the use of levels and the like. When the measurement elements 80 and 82 have been placed on the roll 84, the scope utilized is horizontally swept along such measurement elements until its line of sight intersects each of the measurement elements at the same point outwardly measured from the roll surface. When this has been accomplished, the operator is ensured of a line of sight which is substantially parallel to but removed from the rolls axis of rotation. Inasmuch as the operator knows the exact diameter of the roll in question, and therefore, its radius, the measurement elements 80 and 82 may now be utilized to determine the relative position of a multitude of points on each of the lateral supportive faces of the chock as at 86 and 88 relative to the axis of rotation of the roll. Through the use of measurement elements 90, 92, 94, 96, 98, 100, 102 and 104, the operator can determine the spacial orientation of lateral support faces 86 and 88 of chocks shown generally at 106 and 108. Accordingly, abnormalities such as warp and wear to the chock faces may be readily found and counteracted through the use of corrective spacing elements placed between the lateral supportive faces of the chock and, in the case of the backup roll in question, the mill housing itself. Citings are made with the scope for each of the above-noted measurement elements and the spacial orientation and additional abnormalities of each of the chock faces 86 and 88 as well as the opposite side lateral supportive faces 110 and 112 are taken and noted. The determination of the spacial orientation of faces 110 and 112 is done in an exactly similar manner as that for faces 86 and 88. It should be noted that in all cases each of the measurement elements 90, 92, 94, 96, 98, 100, 102 and 104 are placed perpendicular to the lateral supportive face of the chock in question are levelled to the extent possible and are read through the scope so as to determine their relative position with regard to the axis of rotation of the roll in question utilizing the standards 80 and 82 for measurement purposes.

Figure 8:
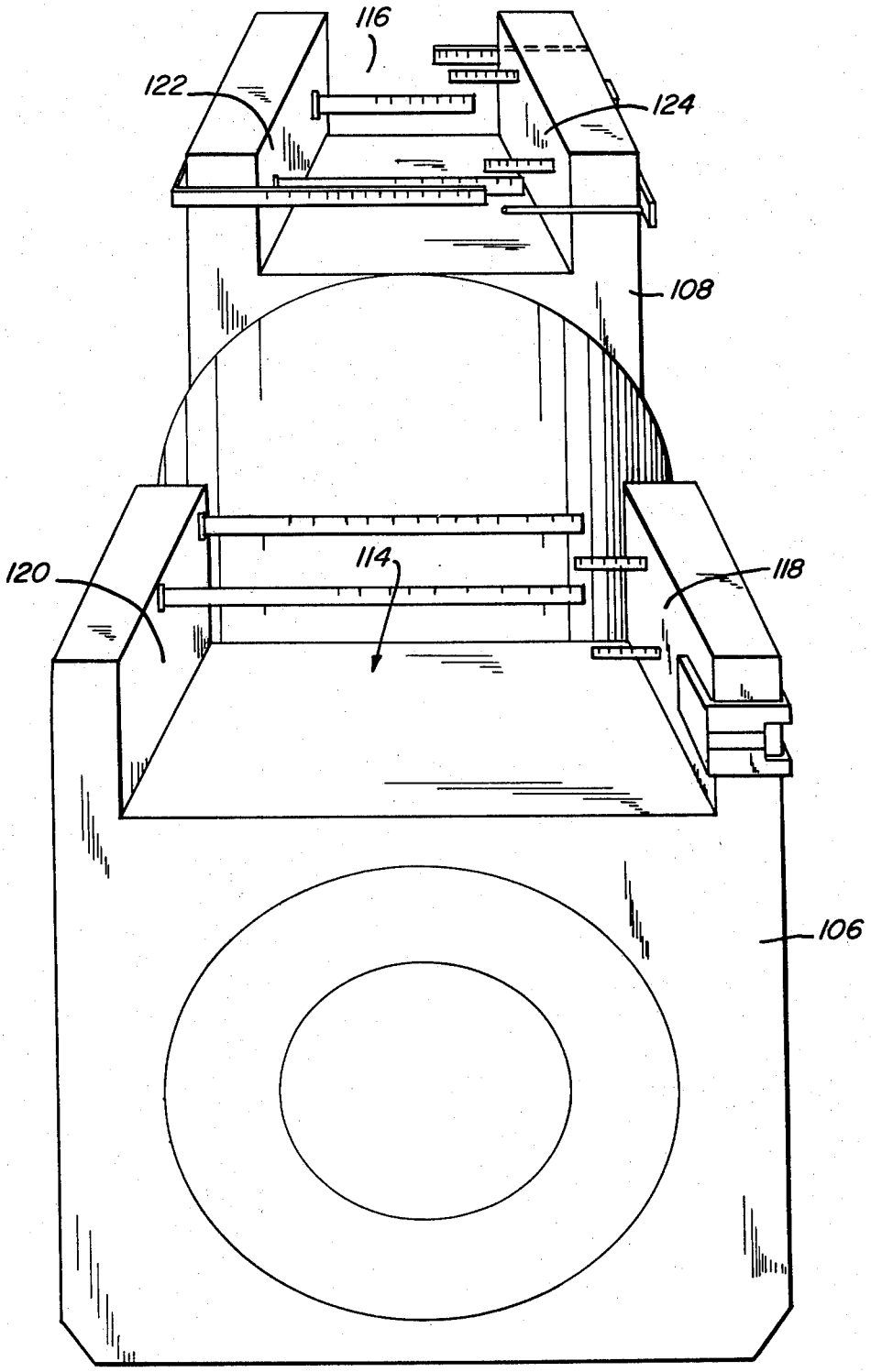
FIG. 8 is a prospective view of the relative position of measurement scales with regard to a backup roll for determining the spacial orientation of the inside windows of the backup roll in accordance with the method of the present invention.

Looking to FIG. 8, there is shown the same backup roll indicated in FIG. 7 with measurement provisions for the determination of the spacial orientation of the inside windows 114 and 116 of chocks 106 and 108, respectively. The method described above for determining the spacial orientation of the exterior lateral support faces of the chock is equally applicable in the case of the measurement and determination of the spacial orientation of the inside window faces 118, 120, 122 and 124 of chocks 106 and 108. Inasmuch as the method described above is applied in the same manner with regard to the inside windows and their spacial orientation, such method will not be further described herein. In much the same manner, the situation presented in FIG. 9 also utilizes the same method described above.

Figure 9:
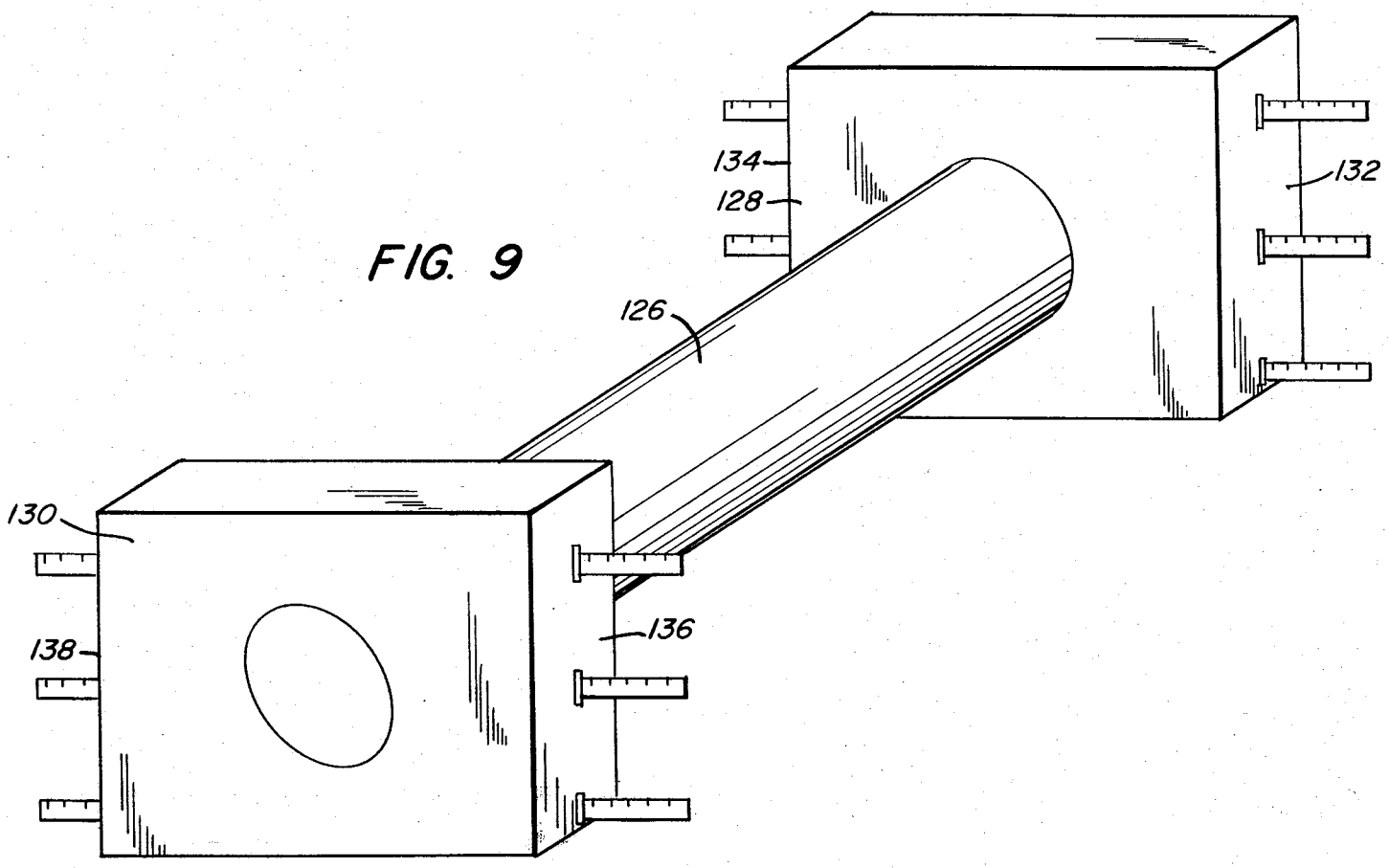
FIG. 9 is a prospective view of a work roll with associated measurement scales employed to determine the spacial orientation of the lateral support faces of the work roll chocks in accordance with the method of the present invention.

Looking to FIG. 9, there is shown a work roll 126 and associated supportive chocks 128 and 130. Both the lateral supportive faces 132 and 134 of chock 128 and lateral support faces 136 and 138 of chock 130 have their spacial orientations determined in exactly the same manner as the exterior lateral support faces 86 and 88 were determined relative in FIG. 7. The orientation of the chock faces to be measured may, if the operator desires, be made in an additional "loaded" orientation merely by rotating the lateral chock faces 90 degrees to a position in which they are horizontally located. It should be apparent that when such determinations have been made and the operator is appreciative of the orientation of each of the faces with regard to the associated roll's axis of rotation, that corrective shims and spacing elements may be selectively placed at the proper locations such that the axis of rotation of all rolls whether their lateral support is derived from the mill itself or from the inside windows of backup rolls may be made.

Figure 10A:
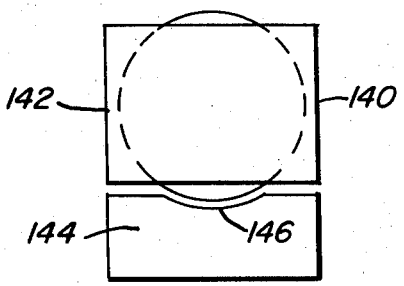
FIG. 10*a* is a representative view of the apparatus by which the work rolls are supported during the determination of the spacial orientation of the lateral support faces of the work roll chocks.
Figure 10B:
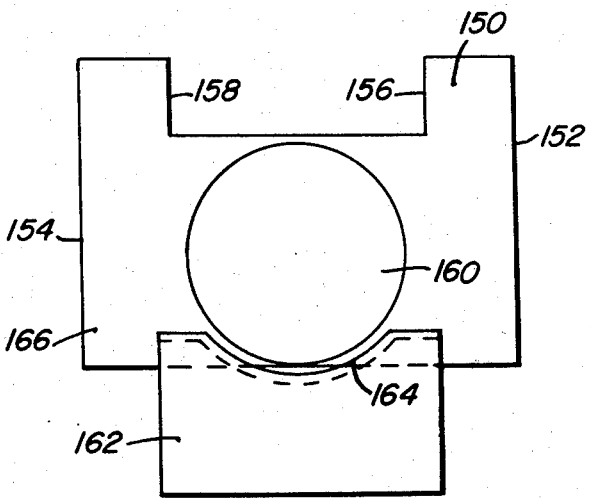
FIG. 10*b* is a representative view of the apparatus by which the work rolls are supported during the determination of the spacial orientation of the lateral support faces of the top backup roll chocks.
Figure 11:
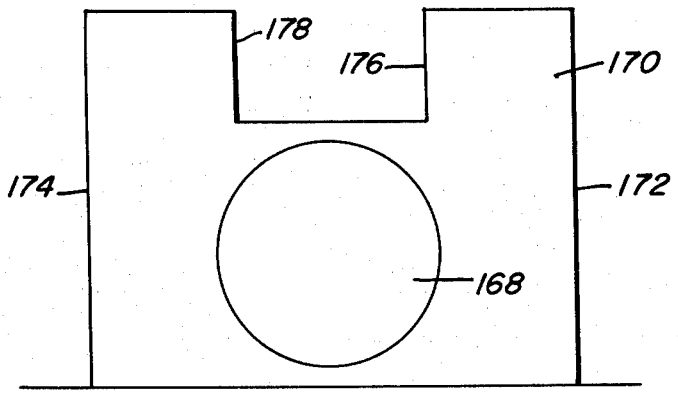
FIG. 11 is a representative view of the bottom backup roll and chock assembly positioned on a relatively level surface and in a position in which the spacial orientation of the lateral support faces of the bottom backup roll chocks may be determined.

Looking to FIGS. 10*a*, 10*b*, and 11, there is shown the necessary supportive structures for the specific rolls and chocks whose spacial orientations must be made. Specifically, FIG. 10*a* shows a common work roll which is supported, during the determination of the spacial orientation of its lateral support faces 140 and 142, by a roll support element 144. The roll's supportive element 144 may be made from any one of a number of variety of elements such as wood or metal but which sits upon the mill floor and has a roll supportive trough 146 which supports the roll and its chock solely by the roll itself. In this manner, the chocks are displaced slightly downwardly with respect to the axis of rotation by any amount of tolerance within the interface between the outside chock elements and the inside neck of the roll itself. Under such circumstances, the roll is in a "loaded" state as it might be within the mill during its operation. Should the work rolls in question be measured when they are supported solely by the chocks, they would be measured during a synthetically derived state and not in a "dynamically loaded" state. By supporting the roll itself, and only the roll itself, and its associated chocks by the roll itself, this latter danger is obviated.

Looking to FIG. 10*b*, there is shown a top backup roll 150 with lateral supportive faces 152 and 154 and interior window faces 156 and 158 and an associated roll 160 contained between the two chocks, only one of which is shown in FIG. 10*b*. In the case of the top backup roll, the supportive entity for the roll and the associated chocks is, in the same manner as the work roll described in FIG. 10*a*, made through a supportive block 162 placed between the mill floor and the roll 160. The supportive entity 162 includes a roll supportive trough 164 which supports the roll 160 and associated chocks during the measurements described above by the roll alone. However, in practice the top back-roll chocks would be rotated 180 degrees (with the legs extending downwardly to achieve a position in which the roll and chocks are in a "loaded" condition. As in the case of the explanation with regard to FIG. 10*a*, the top backup roll is supported in a dynamic loaded state in much the same manner that it would experience while operating within the mill housing itself when rotated 180 degrees as explained above. In this manner, the spacial orientation of the chock faces 152, 154, 156 and 158 of the associated chock 166 are more accurate and are measured when the roll is in its dynamic loaded stated.

Looking to FIG. 11, there is shown a bottom backup roll 168 with one supportive chock 170 shown having lateral exterior supportive faces 172, 174 and interior window faces 176 and 178. In the case of the bottom backup roll it should be noticed that the bottom backup roll 168 is supported during the measurement of the faces of its chock 170 by the mill floor itself and not by any other supportive entity. It will be recognized that the bottom backup roll 168 when supported as shown in FIG. 11 is in its dynamic loaded state as the same would be in the mill housing during the operation of the mill.

It will be recognized that the determination of the spacial orientation of the previously noted chock faces, whether exterior in nature or forming a portion of the interior window, provide the operator with the specific orientations of the chock faces in a manner which could not be realized by previous methods of measurement. Accordingly, the mill operator is provided with information regarding the spacial orientation of the chock faces and any aberration such as warp or a missmilling of the chock face or wear on only one edge of the chock face so that he is better able to determine the size, shape and position of any corrective element which would be placed between that portion of the chock face in question and its lateral supportive entity within the mill itself. It should be obvious that the corrective spacing elements in most cases on one side of a chock face will be equal. However, there are many examples and cases in which the corrective spacing elements necessary for proper alignment of the roll's axis of rotation would not be equal.

In conclusion, it will be seen that there is presented a simple, efficient and highly desirable method of determining the spacial orientation or rolls within a mill (whether such mill of a four-high variety or even a 2 or 3 high mill) and their associated supportive chocks such that the axis of rotation of all the roll within the mill will be substantially parallel to one another for not only the production of good quality product but for the minimization of maintenance to the chocks, rolls and their supportive bearings contained within the chocks. The present method alleviates the need for the rebuilding of chocks, rolls and bearings to the extent previously required due to the inaccuracy of measurements and the incorrect presumption made by the mill operators. The present method requires only several hours for the measurement determination noted above while prior practices involve days, if not weeks, for proper rebuilding of chocks, bearings, races and other chock elements which, in the final end, did not provide the operator with sufficient information to enable him to correctly position the rolls such that they operate and exist in a dynamic state within the mill in a substantially parallel relationship to one another.

While certain changes may be made in the above noted apparatus without departing from the scope of the invention herein involved, it is intended that all matter contained in the above description or shown in the accompanying drawings shall be interpreted as illustrative and not in a limiting sense.

I claim:

1. In a rolling mill of the type having a housing for selectively providing both lateral and vertical support for a plurality of substantially vertically aligned rolls and associated support chocks contained therein, a method of aligning each of the rolls such that their axes of rotation are substantially parallel, said method comprising:

determining the spacial orientation of each of the lateral chock face planes with respect to the axis of rotation of their associated rolls; and selectively placing correcting spacing elements between the lateral chock face planes and their lateral support within the rolling mill to laterally adjust the chock face plane and correspondingly, the axis of rotation of the associated roll so that each axis of rotation of each roll is substantially parallel to the axis of rotation of each of the other rolls.

2. The method according to claim 1 wherein such rolling mill includes two work rolls with associated support chocks and two backup rolls with associated support chocks, both said workup roll chocks and such backup roll chocks being laterally supported by such housing, said selective placing of such correcting spacing elements being effected between the support chocks of each roll and such housing.

3. The method according to claim 1 wherein such rolling mill includes two vertically displaced work rolls with associated support chocks and two vertically displaced backup rolls with associated support chocks, such backup roll chocks being configured having work roll chock supportive faces for providing lateral support for the work roll chocks, said backup roll chocks deriving their lateral support directly from such housing, said selective placing of such correcting spacing elements being effected between such backup roll support chocks and such housing for such backup rolls and between such work roll support chocks and such backup roll supportive faces for such work rolls.

4. The alignment method according to claim 3 wherein such work rolls and associated backup chocks are supported during such measurement and spacial orientation determinations by the work roll itself.

5. The alignment method according to claim 3 wherein such top backup roll and associated backup chocks are supported during such measurement and spacial orientation determinations by the work roll itself.

6. The alignment method according to claim 3 wherein such bottom backup roll and associated backup chocks are supported during such measurement and spacial orientation determinations by the backup chocks.

7. In a rolling mill of the type having a housing for selectively providing both lateral and vertical support for a plurality of substantially horizontally oriented and vertically displaced rolls contained therein, each of such rolls having associated support chocks at each end thereof which are laterally supported by such housing, a method of aligning each of such rolls such that their axes of rotation are substantially mutually parallel, said alignment method comprising:

determining the spacial orientation of each of the lateral chock face planes with respect to the axis of rotation of their associated rolls; and selectively placing corrective spacing elements between the lateral chock face plane and such housing to laterally adjust the chock face plane and, correspondingly, the axis of rotation of the associated roll so that each axis of rotation of each roll is substantially parallel to the axis of rotation of each of the other rolls.

8. The alignment method according to claim 7 wherein the step of determining the spacial orientation of each of the lateral chock faces with respect to the axis of rotation of their associated roll includes the step of determining the linear distance between each of at least three non-linearly arranged points on each of such lateral chock faces and a given plane of known spacial orientation with respect to the axis of rotation of the associated roll.

9. The alignment method according to claim 8 wherein such given plane is oriented normal to a line radially extending from the axis of rotation of the associated roll.

10. The alignment method according to claim 8 wherein the step of determining the linear distance between at least three non-linearly arranged points on each of such lateral chock faces and the axis of rotation of the associated roll includes:

setting up a measurement standard on a given portion of the associated roll in such a manner that such measurement standard extends radially outward from such roll with respect to the axis of rotation of such roll;

placing linear measurement elements on such lateral face of such chocks and normal to such face at at least three different non-linearly arranged points on such face, the chocks being aligned such that such measurement elements are substantially parallel to each other and to such measurement standard; and comparing the distance of each of such at least three different points to a given imaginery plane normal to such measurement standard and of known spacial orientation with respect to the axis of rotation of the associated roll.

11. The alignment method according to claim 7 wherein such rolls are supported during such measurement and spacial orientation determinations by the roll itself.

12. The alignment method according to claim 7 wherein such rolls are supported during such measurement and spacial orientation determinations by the chocks.

13. In a rolling mill of the type having a housing for selectively providing both lateral and vertical support for a plurality of substantially vertically aligned rolls contained therein, such rolls including backup rolls and work rolls, each of such rolls having associated support chocks at each end thereof, such backup rolls being laterally supported by such housing and such work roll chocks being laterally supported within cut-outs in the chocks of such backup rolls, a method of aligning each of the rolls such that their axes of rotation are substantially mutually parallel, said alignment method comprising:

determining the spacial orientation of each of the exterior lateral chock face planes with respect to the axis of rotation of their associated rolls;

determining the spacial orientation of each of the interior lateral chock face planes of the backup chocks with respect to the axis of rotation of their associated rolls; and selectively placing corrective spacing elements between the lateral chock face plane and such housing and between the lateral chock face planes of the work roll chocks and the interior lateral chock face planes of the backup roll chocks to laterally adjust the chock face planes and, correspondingly, the axis of rotation of the associated roll so that each axis of rotation of each roll is substantially parallel to the axis of rotation of each of the other rolls.

14. The alignment method according to claim 13 wherein the step of determining the spacial orientation of each of the exterior lateral chock faces with respect to the axis of rotation of their associated roll includes the step of determining the linear distance between each of at least three non-linearly arranged points on each of such exterior lateral chock faces and a given plane of known spacial orientation with respect to the axis of rotation of the associated roll.

15. The alignment method according to claim 14 wherein such given plane is oriented normal to a line radially extending from the axis of rotation of the associated roll.

16. The alignment method according to claim 14 wherein the step of determining the linear distance between at least three non-linearly arranged points on each of such exterior lateral chock faces and the axis of rotation of the associated roll includes:

setting up a measurement standard on a given portion of the associated roll in such a manner that such measurement standard extends radially outward from such roll with respect to the axis of rotation of such roll;

placing linear measurement elements on such exterior lateral face of such chocks and normal to such face at at least three different non-linearly arranged points on such face, the chocks being aligned such that such measurement elements are substantially parallel to each other and to such measurement standard; and comparing the distance of each of such at least three different points to a given imaginary plane normal to such measurement standard and of known spacial orientation with respect to the axis of rotation of the associated roll.

17. The alignment method according to claim 13 wherein the step of determining the spacial orientation of each of the interior lateral chock face planes of the backup chocks with respect to the axis of rotation of the associated backup roll includes the step of determining the linear distance between a plurality of non-linearly arranged points on each of such interior lateral chock faces and a given plane of known spacial orientation with respect to the axis of rotation of the associated roll.

18. The alignment method according to claim 17 in which the step of determining the linear distance is made between at least three non-linearly arranged points on each of such interior lateral chock faces and a given plane of non-spacial orientation with respect to the axis of rotation of the associated roll.

19. The alignment method according to claim 18 wherein such given plane of non-spacial orientation is orientated normal to a line radially extending for the axis of rotation of the associated roll.

20. The alignment method according to claim 17 wherein the step of determining the linear distance between such plurality of non-linearly arranged points on each of such interior lateral chock faces and the axis of rotation of the associated roll includes:

setting up a measurement standard on a given portion of the associated roll in such a manner that such measurement standard extends radially outward from such roll with respect to the axis of rotation of such roll;

placing linear measurement elements on such interior lateral face of such backup roll chocks normal to such face at such plurality of non-linearly arranged points on such face, the backup roll chocks being aligned such that such measurement elements are substantially parallel to each other and to such measurement standard;

comparing the distance of each of such plurality of non-linearly arranged points to a given imaginary plane normal to such measurement standard and of non-spacial orientation with respect to the axis of rotation of the associated roll.

21. The alignment method according to claim 13 wherein such work rolls and associated backup chocks are supported during such measurement and spacial orientation determinations by the work roll itself.

22. The alignment method according to claim 13 wherein such top backup roll and associated backup chocks are supported during such measurement and spacial orientation determinations by the work roll itself.

23. The alignment method according to claim 13 wherein such bottom backup roll and associated backup chocks are supported during such measurement and spacial orientation determinations by the backup chocks.

* * * * *

UNITED STATES PATENT AND TRADEMARK OFFICE

CERTIFICATE OF CORRECTION

PATENT NO. : 4,290,289

DATED : September 22, 1981

INVENTOR(S) : Alfred J. Capriotti

It is certified that error appears in the above-identified patent and that said Letters Patent are hereby corrected as shown below:

In the Abstract, line 6, change "special" to -- spacial --.

Column 11, line 1, change "or" to -- of --.

Signed and Sealed this

*Eighth* Day of *December 1981*

[SEAL]

*Attest:*

GERALD J. MOSSINGHOFF

*Attesting Officer*

*Commissioner of Patents and Trademarks*